US010264881B2

(12) United States Patent
Turner

(10) Patent No.: US 10,264,881 B2
(45) Date of Patent: Apr. 23, 2019

(54) MULTI-ORIENTATION MODULAR FURNITURE HAVING AN ENERGY RELEASABLE DESIGN

(71) Applicant: Viggi Corporation, Fairport, NY (US)

(72) Inventor: Sandra Turner, Fairport, NY (US)

(73) Assignee: Viggi Corp., Fairport, NY (US)

( * ) Notice: Subject to any disclaimer, the term of this patent is extended or adjusted under 35 U.S.C. 154(b) by 395 days.

(21) Appl. No.: 14/864,017

(22) Filed: Sep. 24, 2015

(65) Prior Publication Data

US 2016/0095428 A1 Apr. 7, 2016

Related U.S. Application Data

(63) Continuation-in-part of application No. 13/753,615, filed on Jan. 30, 2013, now Pat. No. 9,179,770.

(60) Provisional application No. 61/592,146, filed on Jan. 30, 2012.

(51) Int. Cl.

| | |
|---|---|
| ***A47B 85/04*** | (2006.01) |
| ***A47B 87/00*** | (2006.01) |
| ***A47B 39/00*** | (2006.01) |
| ***A47C 3/04*** | (2006.01) |
| ***A47C 3/029*** | (2006.01) |
| ***A47D 11/00*** | (2006.01) |
| ***A47D 1/04*** | (2006.01) |

(52) U.S. Cl.

CPC ..... *A47B 85/04* (2013.01); *A47B 39/00* (2013.01); *A47B 87/002* (2013.01); *A47C 3/029* (2013.01); *A47C 3/04* (2013.01); *A47D 1/04* (2013.01); *A47D 11/00* (2013.01); *A47D 11/002* (2013.01)

(58) Field of Classification Search

CPC ..... A47B 85/04; A47B 87/002; A47D 11/002; A47C 3/04; A47C 3/029

See application file for complete search history.

(56) References Cited

U.S. PATENT DOCUMENTS

| | | | | |
|---|---|---|---|---|
| 1,729,941 A | | 10/1929 | Hocking et al. | |
| 3,380,735 A | * | 4/1968 | Rigby | A63B 22/18 472/135 |
| 3,526,429 A | * | 9/1970 | Metzger | A47C 3/029 297/271.5 |

(Continued)

OTHER PUBLICATIONS

Classroom Seating Solutions; http://www.classroomseatingsolutions.com; Mar. 14, 2011 4 webpages.

(Continued)

*Primary Examiner* — David R Dunn
*Assistant Examiner* — Tania Abraham
(74) *Attorney, Agent, or Firm* — Dinsmore & Shohl LLP

(57) ABSTRACT

Furniture pieces are disclosed. A furniture piece includes a body, a non-flat base surface, a seat surface, a back protrusion, a pair of opposed side surfaces, and apertures. The non-flat base surface is positioned on a first side of the body, and the seat surface is positioned on a second side of the body opposite the first side. The back protrusion extends outward from the second side of the body adjacent the seat surface. The pair of opposed side surfaces are positioned on opposite sides of the body extending between the first and second sides. Apertures are defined in each of the side surfaces. Each aperture has an upper surface facing in a direction opposite the seat surface.

18 Claims, 11 Drawing Sheets

(56) References Cited

U.S. PATENT DOCUMENTS

| | | | | | |
|---|---|---|---|---|---|
| 3,556,586 | A | | 1/1971 | Beardmore | |
| 3,604,749 | A | * | 9/1971 | Parmett | A47C 3/04 297/239 |
| 4,050,736 | A | * | 9/1977 | Karp | A47B 83/02 297/135 |
| 4,109,960 | A | * | 8/1978 | Stinchfield | A47C 3/029 297/271.5 |
| 4,141,588 | A | * | 2/1979 | Anderson | A47D 13/102 297/271.5 |
| 4,205,876 | A | * | 6/1980 | Cetina | A47D 1/00 297/118 |
| D255,959 | S | | 7/1980 | Mitchell | |
| 4,241,949 | A | * | 12/1980 | Parker | A47C 3/029 297/270.3 |
| 4,505,265 | A | | 3/1985 | Cronenwett et al. | |
| 4,615,562 | A | * | 10/1986 | Bell | B60N 2/2806 297/256.14 |
| 4,854,638 | A | * | 8/1989 | Marcus | A47D 1/103 297/256.11 |
| 4,968,091 | A | | 11/1990 | Mariol | |
| 5,213,394 | A | * | 5/1993 | Tattrie | A47C 1/143 297/188.2 |
| 5,692,799 | A | * | 12/1997 | Sheets | A47B 85/04 108/12 |
| 5,795,276 | A | | 8/1998 | Almeda | |
| 5,887,944 | A | * | 3/1999 | Boost | A47C 3/029 297/258.1 |
| 5,899,838 | A | | 5/1999 | Jacobs | |
| 6,155,641 | A | * | 12/2000 | Frost | A47C 3/20 108/11 |
| 6,702,391 | B1 | * | 3/2004 | Stipek | A47C 5/12 297/451.12 |
| 6,857,696 | B2 | * | 2/2005 | Usagani | A47B 85/00 297/1 |
| 7,033,307 | B2 | | 4/2006 | Van Straaten | |
| 7,097,241 | B2 | | 8/2006 | Tally et al. | |
| D548,986 | S | | 8/2007 | McCoy et al. | |
| 8,070,229 | B2 | * | 12/2011 | Woodring | A47C 3/029 297/239 |
| 8,783,778 | B2 | | 7/2014 | Nelson et al. | |
| 2004/0032152 | A1 | | 2/2004 | Tally | |
| 2004/0070238 | A1 | * | 4/2004 | Moser | A47K 3/282 297/183.9 |
| 2014/0152059 | A1 | | 6/2014 | Swy | |

OTHER PUBLICATIONS

Final Office Action for U.S. Appl. No. 14/863,988, dated May 13, 2016.

Non Final Office Action for U.S. Appl. No. 14/863,988, dated Dec. 15, 2015.

* cited by examiner

MULTI-ORIENTATION MODULAR FURNITURE HAVING AN ENERGY RELEASABLE DESIGN

CROSS-REFERENCE TO RELATED APPLICATIONS

The present application is a continuation-in-part of U.S. patent application Ser. No. 13/753,615, filed Jan. 30, 2013, entitled "MULTI-ORIENTATION MODULAR FURNITURE HAVING AN ENERGY RELEASABLE DESIGN," which claims priority to U.S. Patent Application No. 61/592,146, filed on Jan. 30, 2012, the contents of each of which are incorporated herein by reference in their entireties.

BACKGROUND OF THE INVENTION

Classroom environments conventionally provide a static setting for learning. These environments usually consist of a "student area" where a student can sit and have a work surface. In the most conventional setting, the student area consists of a conventional desk configuration, which includes a desk base that supports a work surface, as well as, a seat to position the student in a positional relationship to the work surface. These conventional desk configurations have been designed for a single basis purpose, to provide a work area for a student to learn.

However, studies have shown that static classroom settings do not necessarily provide an efficient environment for learning for many students. More specifically, these studies have found that a dynamic classroom setting may provide an effective learning environment.

One way to realize a dynamic classroom setting is to periodically re-arrange the physical environment, such as moving the conventional desks into various physical arrangements, such as a cluster arrangement or a circular arrangement. Another arrangement would be to "remove" the desks so that the students either stand in a certain area or even sit of the floor or mat to facilitate the learning process.

One issue in realizing a physical dynamic classroom setting is that the conventional desks are not easily moved and can be bulky, thereby hindering an effective "removal" thereof.

Another way to realize a dynamic classroom setting is to provide for positive non-disruptive distractions, such as using multi-media to break-up traditional lectures. Such positive non-disruptive distractions are usually classroom wide; however, these positive non-disruptive distractions do not always provide the "break" some students need to enable them to re-focus on the learning process.

In such situations, individual positive non-disruptive distractions are desirable.

An example of a conventional individual positive non-disruptive distraction device to provide a means for the student to use to assist in re-focusing the student on the learning process is illustrated in FIG. 12.

As illustrated in FIG. 12, a foot rest device 1100 is connected to the legs 1000 of a conventional desk by straps 1200. The straps 1200 are not rigid, thereby allowing some three-dimensional movement of the foot rest device 1100.

The conventional individual positive non-disruptive distraction device of FIG. 12 provides a mechanism for the student to non-disruptively release energy so as to assist in re-focusing the student on the learning process.

Although this conventional individual positive non-disruptive distraction device provides for energy release, the device hinders the stackability of the conventional desk, and thereby hinders the efficient "removal" of the desks.

Therefore, it is desirable to provide classroom "desks" which provide easy and effective dynamic classroom settings. Moreover, it is desirable to provide classroom "desks" which provide easy and effective dynamic classroom settings and an effective individual positive non-disruptive distraction mechanism.

BRIEF DESCRIPTION OF THE DRAWINGS

The drawings are only for purposes of illustrating various embodiments and are not to be construed as limiting, wherein.

DETAILED DESCRIPTION OF THE INVENTION

Figure 1:
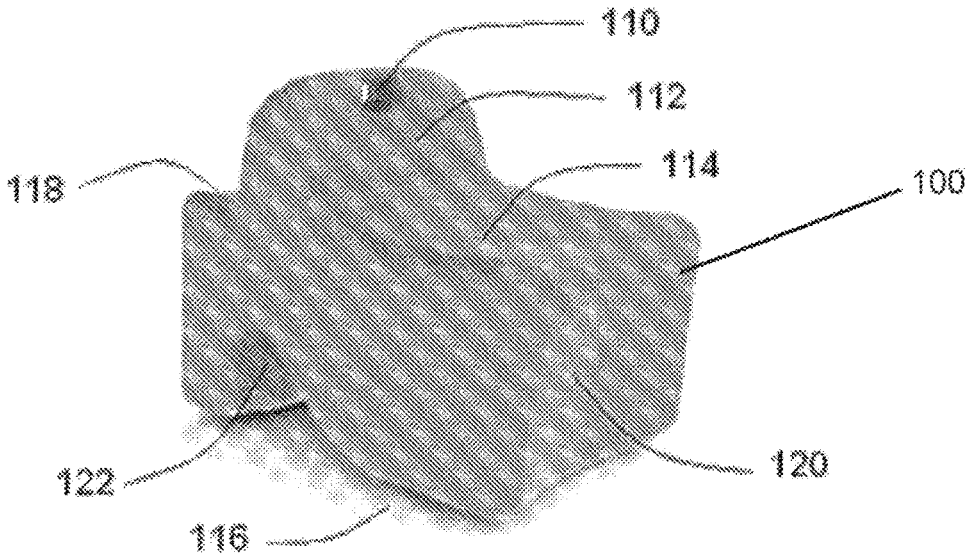
FIG. 1 is a perspective view of an exemplary multi-orientation modular furniture piece shown in a seating orientation.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

Figure 2:
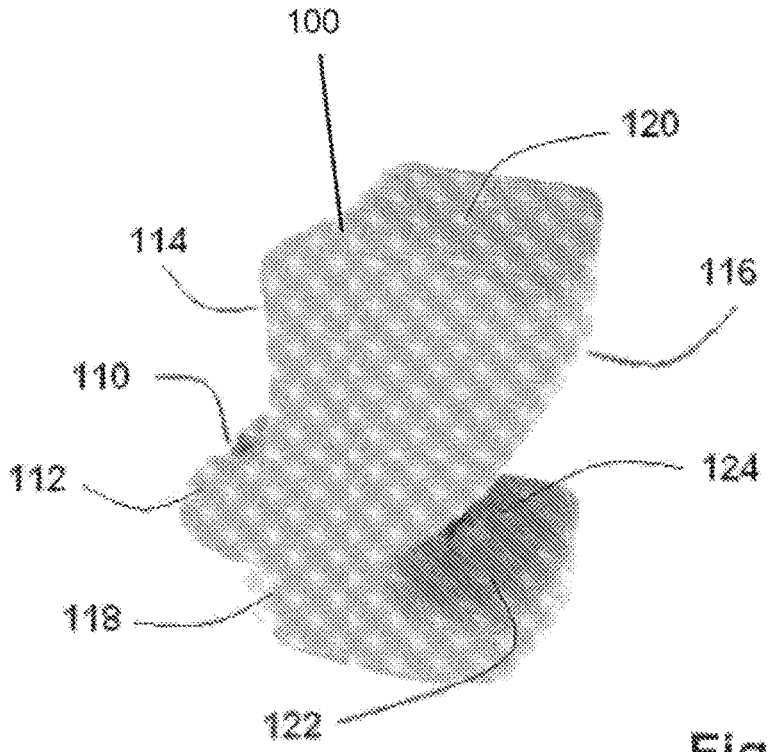
FIG. 2 is a perspective isometric view of an exemplary multi-orientation modular furniture piece shown in a stool orientation.
Figure 3:
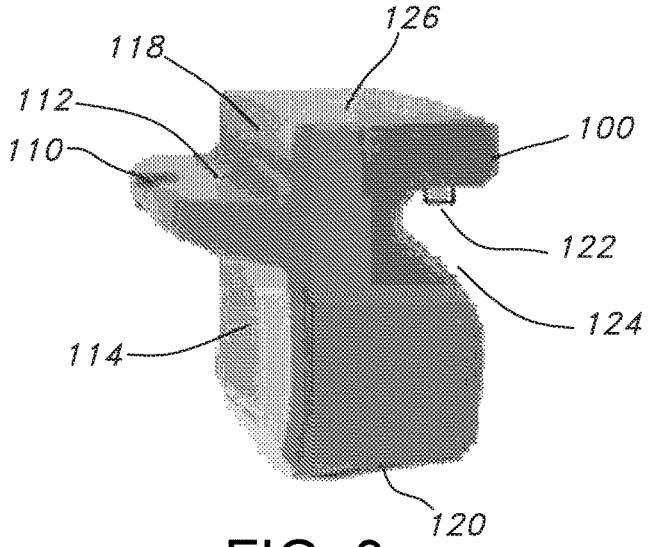
FIG. 3 is a perspective isometric view of an exemplary multi-orientation modular furniture piece shown in a desk orientation.

FIGS. 1 through 3 illustrate an example of multi-orientation modular furniture. As illustrated in FIG. 1, a multi-orientation modular furniture piece 100 is illustrated in a seat orientation, with seat surface 114 providing the sitting surface.

Figure 13A:
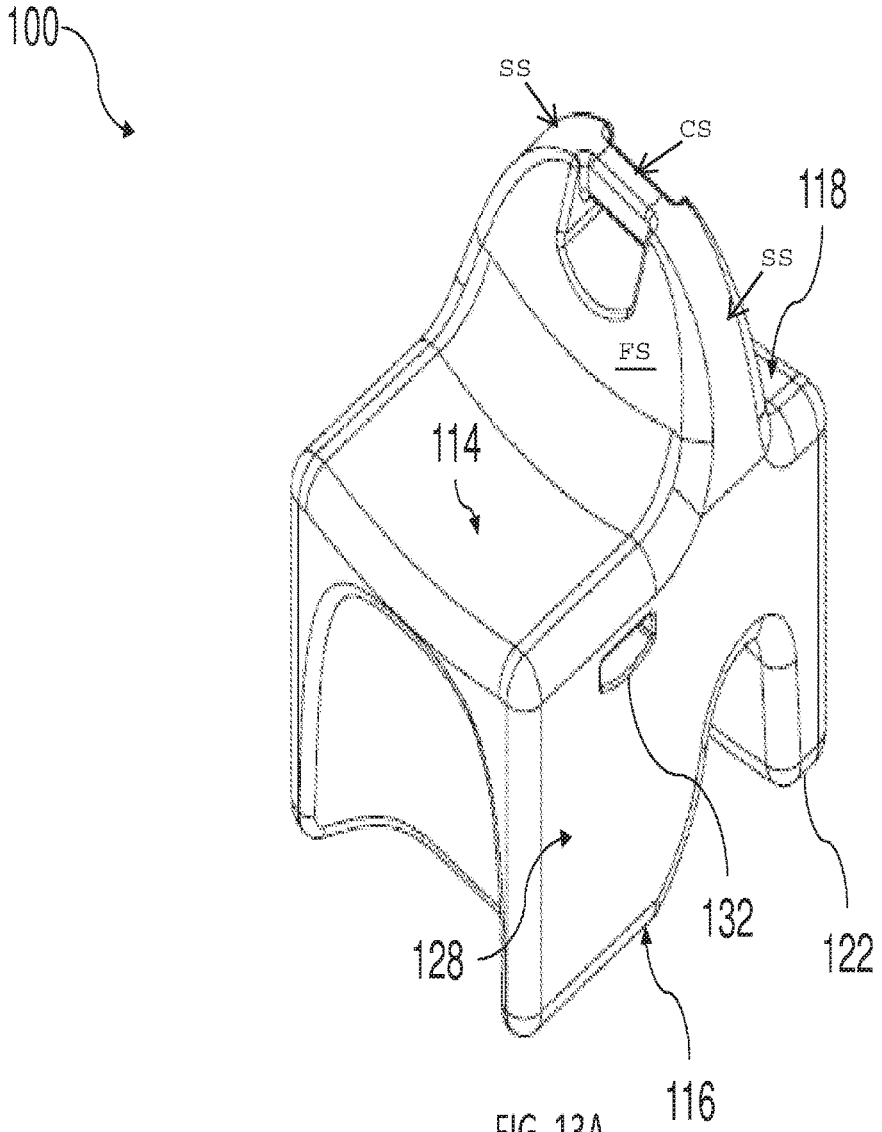
FIGS. 13A and 13B are perspective and side views, respectively, of a multi-orientation modular furniture piece including exemplary handles.
Figure 13B:
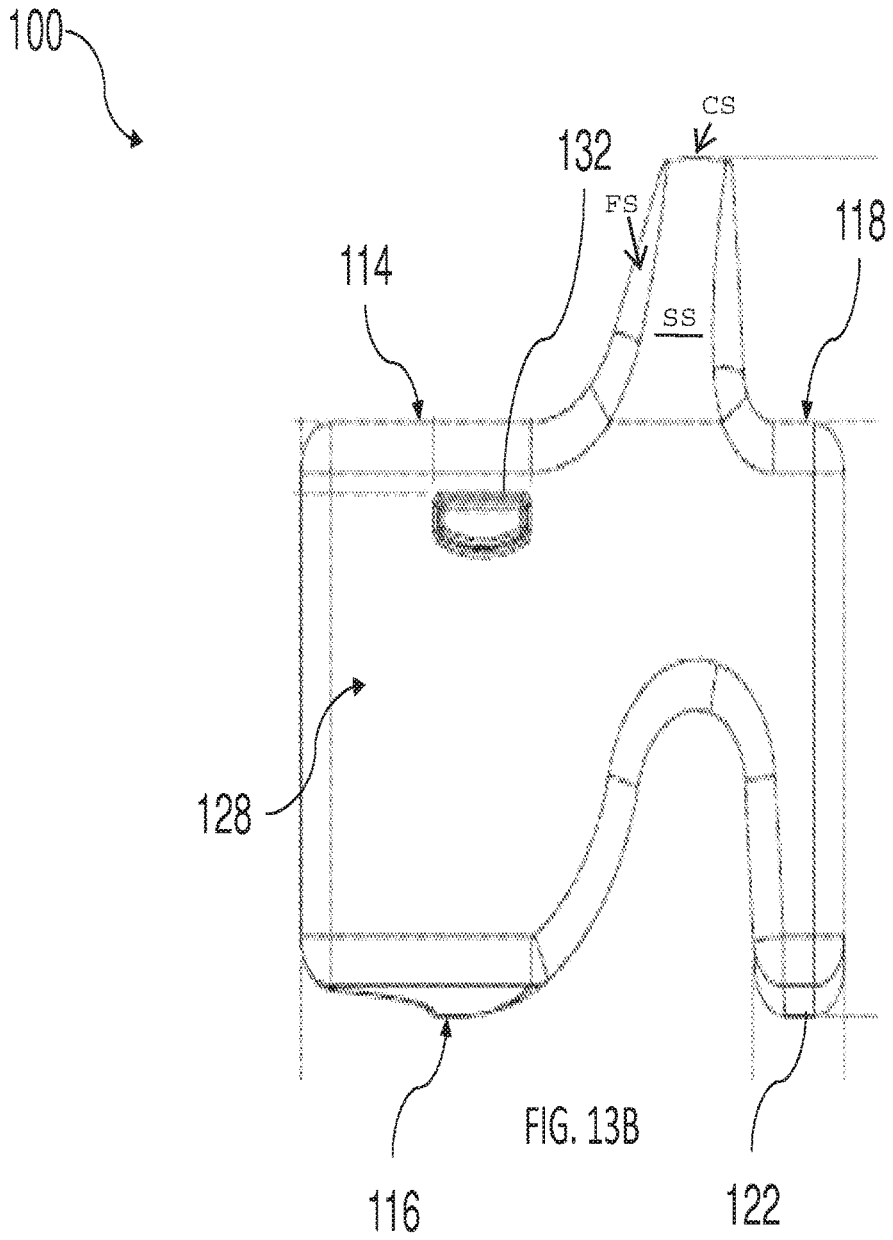

The multi-orientation modular furniture piece 100 includes a handle 110. Seat surface 114 may be provided with a suitable concave area to sit upon. A back protrusion 112 is included to provide a backrest function for the sitting functionality. The back protrusion 112 including a pair of side surfaces SS and a connecting surface CS disposed therebetween (as illustrated in FIGS. 13A-13B) may include a concave portion to provide support for the lumbar area of the back such that a first surface FS between the pair of side surfaces SS is adjacent to and extends outwardly from the seat surface 114.

As illustrated, within back protrusion 112, an aperture serves as the handle 110. It is noted that the handle 110 may provide engagement between modules when used in cooperation with protrusion 124, as illustrated in FIG. 2.

Figure 4:
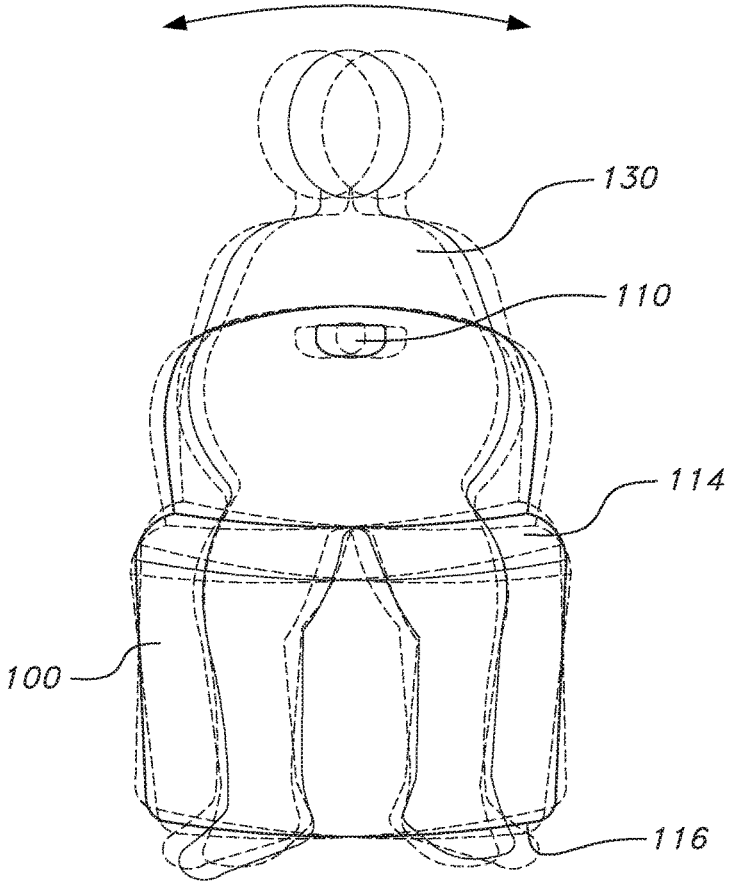
FIG. 4 is a further perspective view of FIG. 1 including an occupant in a rocking motion of the multi-orientation modular furniture piece.

The multi-orientation modular furniture piece 100 includes a base surface 116, which when in the seat orientation, provides the base of the seat that engages the floor. Base surface 116 is not completely flat, but may be convex or irregular, to provide a seat occupant with a minimal left to right rocking motion. The rocking motion of the occupant 130 is illustrated in FIG. 4.

In addition, the multi-orientation modular furniture piece 100 includes a base protrusion 122 that engages the floor to provide further stability for the seat orientation. The base protrusion 122 may include a convex or irregular surface to facilitate the minimal left to right rocking motion.

The availability of rocking motion allows the occupant to release energy, thereby allowing the maintenance of the occupant's alertness and focus. It is noted that base surface 116 provides a stable foundation for the sitting function, but the convex or irregular aspects in base surface 116 allows the occupant to actively bring about the minimal left to right rocking motion. The minimal left to right rocking motion can provide a positive non-disruptive distraction for the occupant to facilitate a non-disruptive release of energy so as to assist in re-focusing the occupant during the learning process.

Shelf surface 118 is included and may provide a convenience surface area for holding readily accessible objects, such as pencils, books, and the like.

FIG. 2 illustrates the multi-orientation modular furniture piece 100 rotated counterclockwise, from the seat orientation illustrated in FIG. 1, to provide a stool orientation, allowing stool functionality.

As illustrated in FIG. 2, the multi-orientation modular furniture piece 100 includes a stool surface 120 to provide the sitting surface. Stool surface 120 may include a curved portion to enhance the sitting functionality. Moreover, base protrusion 122 engages the floor to provide the base for the stool orientation.

In the stool orientation, back protrusion 112 may be used as a possible foot rest.

FIG. 3 shows the multi-orientation modular furniture piece 100 inverted from the stool orientation of FIG. 2, to provide a desk orientation, allowing desk functionality. In the desk orientation, the multi-orientation modular furniture piece 100 includes work surface 126 to provide a work surface. Back protrusion 112 may also provide a work surface in the desk orientation.

In the desk orientation, stool surface 120 engages the floor to provide the base for the desk orientation.

It is noted that providing the various curves surfaces, the multi-orientation modular furniture piece 100 can provide an ergonomic design.

The multi-orientation modular furniture piece 100 may be constructed from a polyethylene (PE) plastic or a high density polyethylene (HDPE) plastic.

Moreover, the multi-orientation modular furniture piece 100 may be manufactured as a hollow core product to facilitate easier orientation.

In addition, the multi-orientation modular furniture piece 100 may be manufactured using colorants to provide a more pleasant atmosphere within the learning environment.

Figure 5:
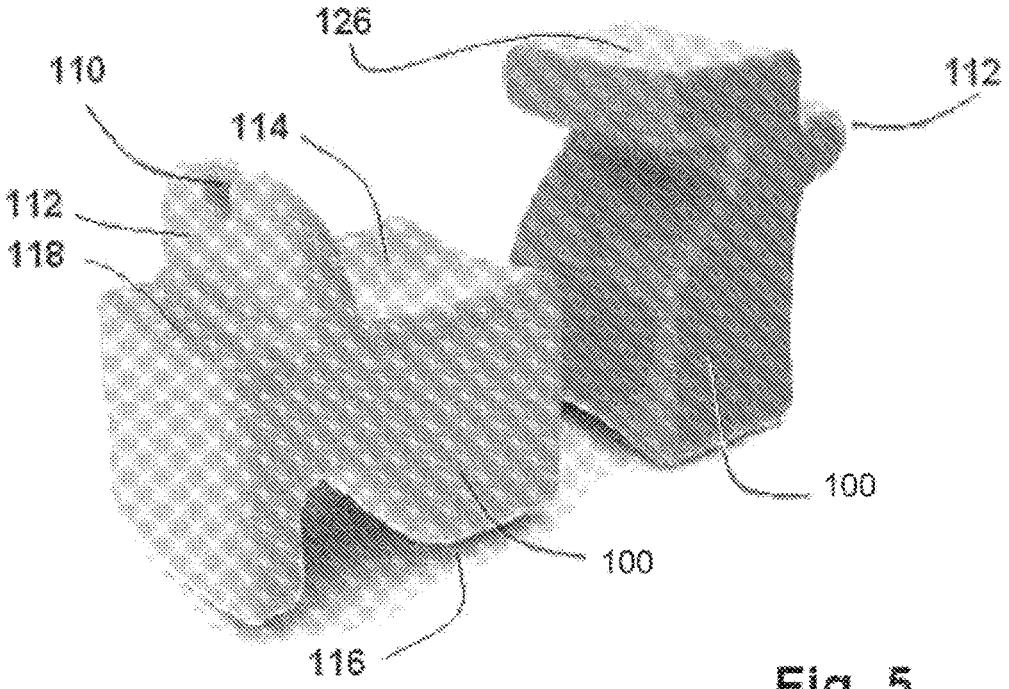
FIG. 5 is a perspective view of the seating orientation (FIG. 1) used in combination with the desk orientation (FIG. 3)

FIG. 5 illustrates two multi-orientation modular furniture pieces 100 in two different orientations to provide a desk/chair combination. Placing a first multi-orientation modular furniture piece 100 in the seat orientation of FIG. 1 serves as the chair, and placing a second multi-orientation modular furniture piece 100 in the desk orientation of FIG. 3 serves as the desk. This desk/chair combination is readily movable, stackable, and/or reconfigurable.

As previously noted, one aspect of multi-orientation modular furniture piece 100 is the ability to conjoin multi-orientation modular furniture pieces 100 into various useful configurations. However, it should be noted, that a significant aspect of the multi-orientation modular furniture piece 100 further supports the formation of dual work stations 126, as illustrated in FIG. 6.

Figure 6:
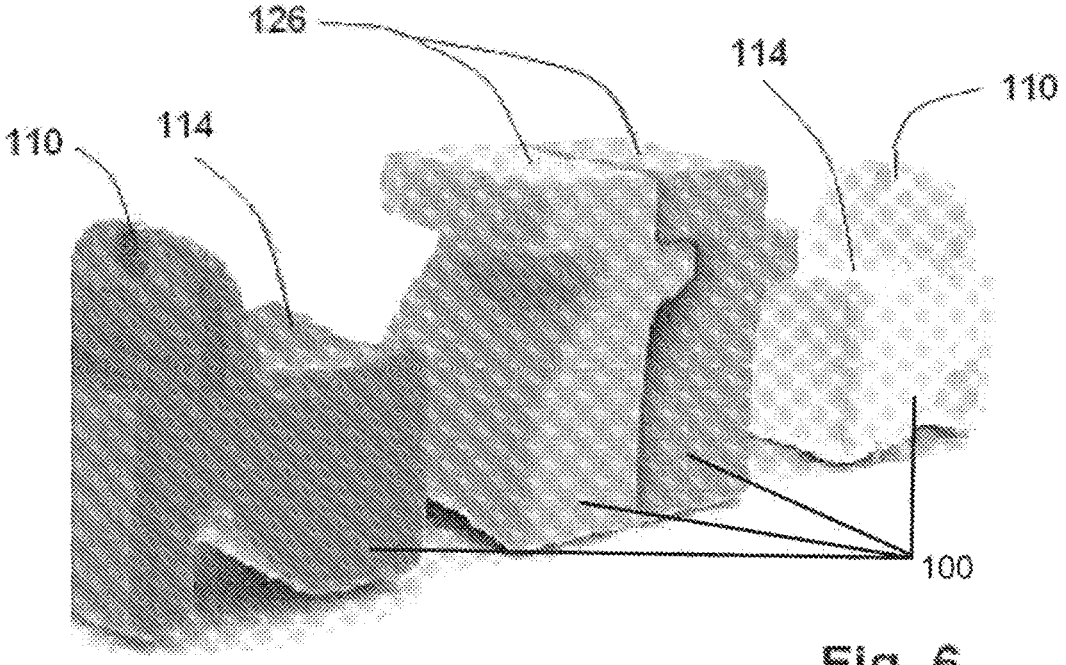
FIG. 6 is a perspective view of the desk/chair combination of FIG. 5 used in conjunction with another desk/chair combination.

The configuration of FIG. 6 may provide for collaboration among the participants in a possible collage of randomly paired desks.

Figure 7:
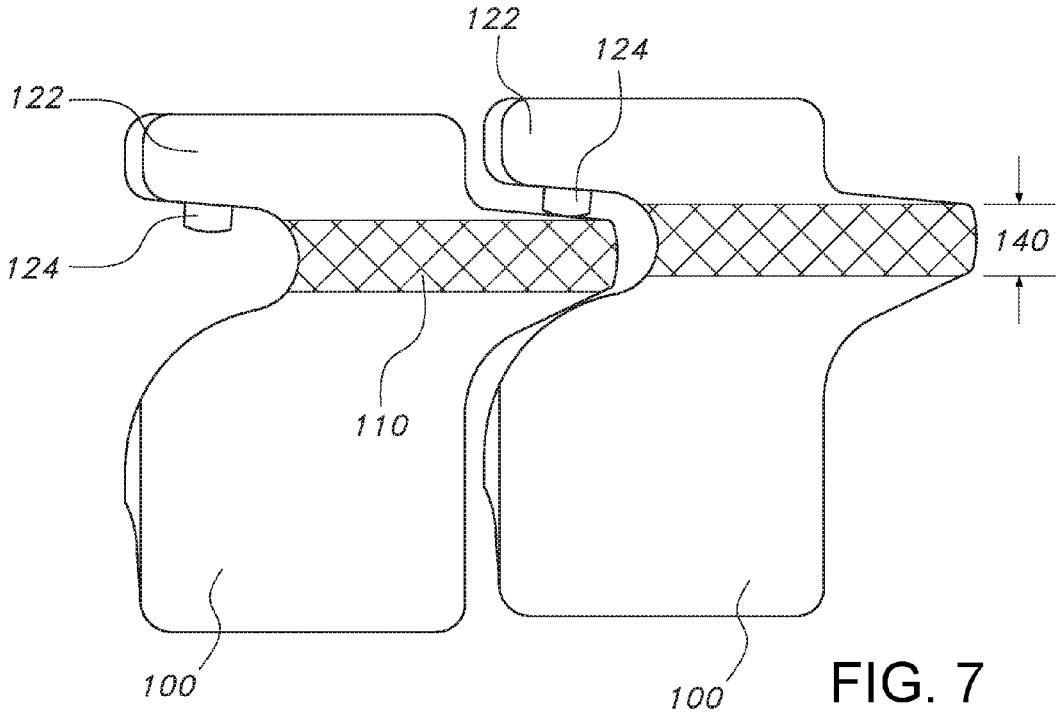
FIG. 7 is a partial perspective view of FIG. 5 illustrating the interlocking feature of two multi-orientation modular furniture pieces conjoined in the desk orientation.

As illustrated in FIG. 7, multi-orientation modular furniture pieces 100 can be mechanically connected by protrusion 122 engaging handle 110 to two-dimensionally restrain one multi-orientation modular furniture piece 100 to another multi-orientation modular furniture piece 100.

Figure 8:
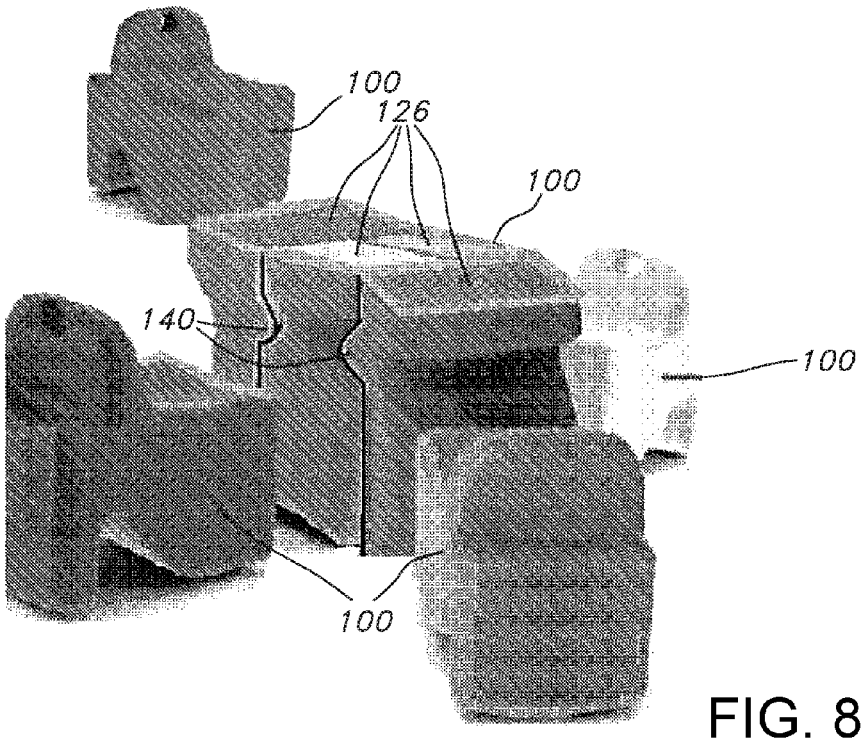
FIG. 8 is a perspective view of the desk/chair combination of FIG. 6 used in conjunction with another desk/chair combination.
Figure 9:
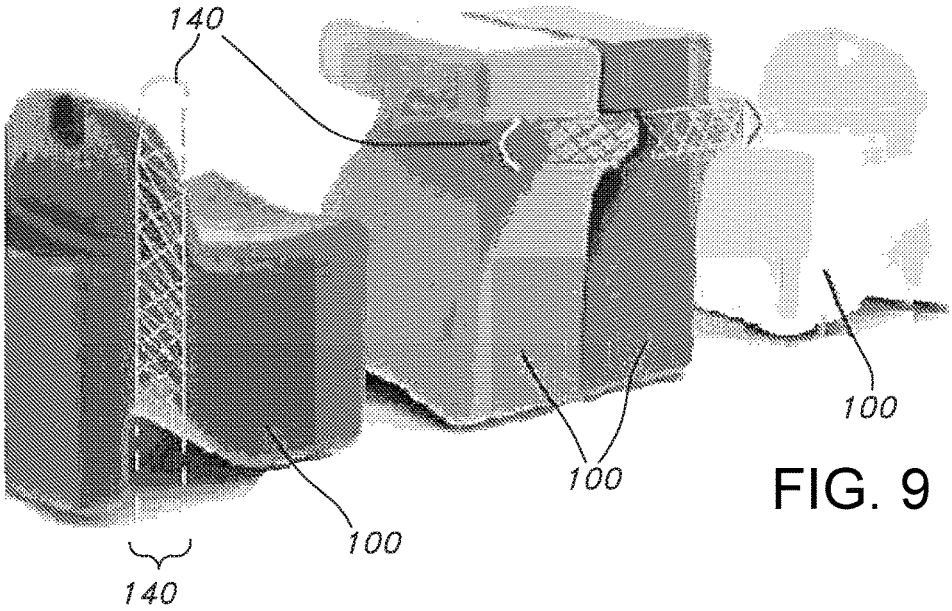
FIG. 9 is a further perspective view illustrating the interlocking feature of two multi-orientation modular furniture pieces.

In addition as illustrated in FIGS. 7 and 9, an additional indentation 140 may be provided to enable multi-orientation modular furniture pieces 100 placed on either side of each other to be constrained. The additional indentation 140 may engage the back protrusion 122. This allows the work surface configuration 126 illustrated in FIG. 8 to be more rigidly connected.

Figure 10:
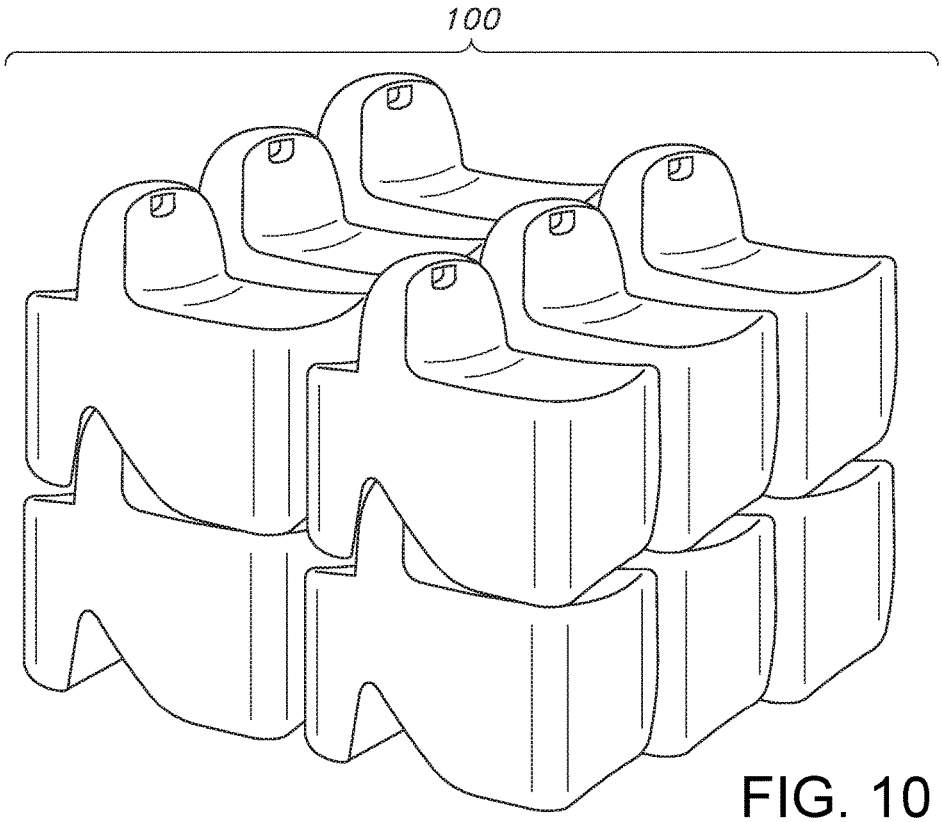
FIG. 10 is a perspective view of the multi-orientation modular furniture pieces in a storage position.

As illustrated in FIG. 10, when the multi-orientation modular furniture pieces 100 are orientated in the seat orientation, the multi-orientation modular furniture pieces 100 are readily stacked vertically and can be nested horizontally.

Figure 11:
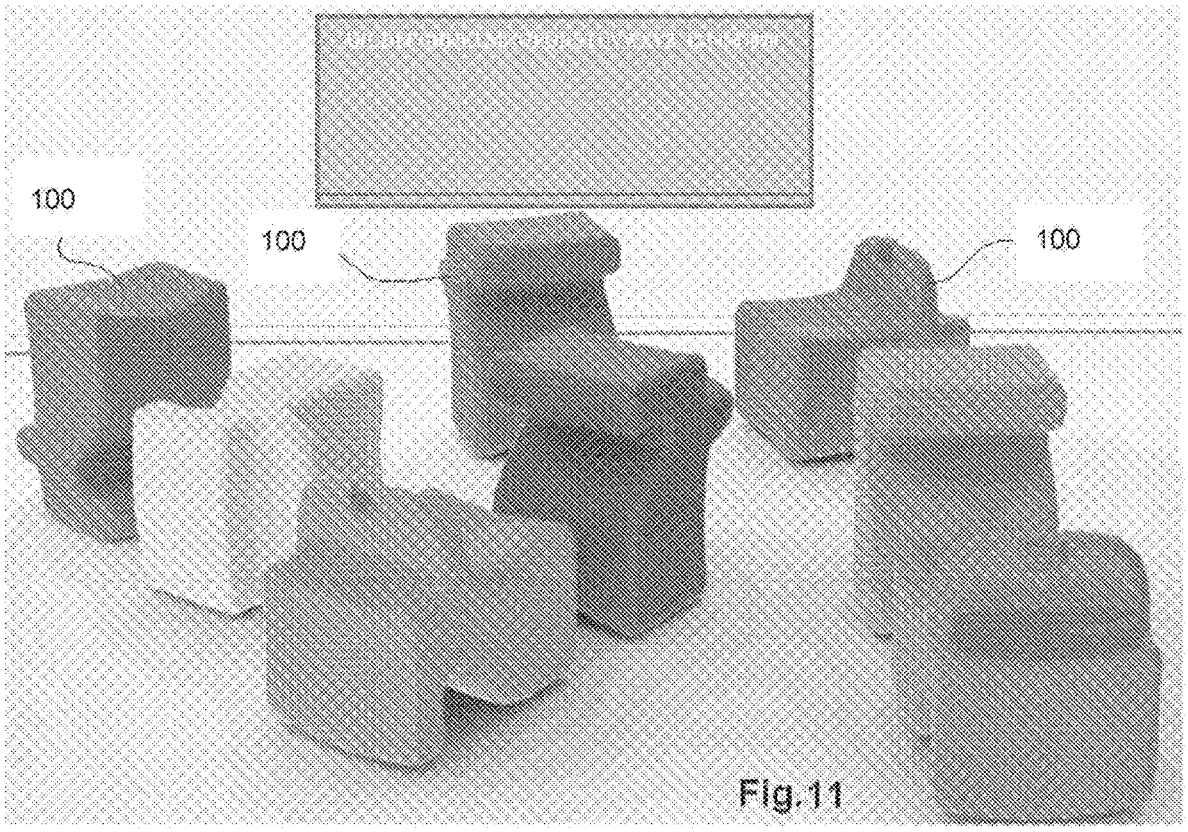
FIG. 11 is a learning environment layout consisting of a plurality of multi-orientation modular furniture pieces used for various different needs.
Figure 12:
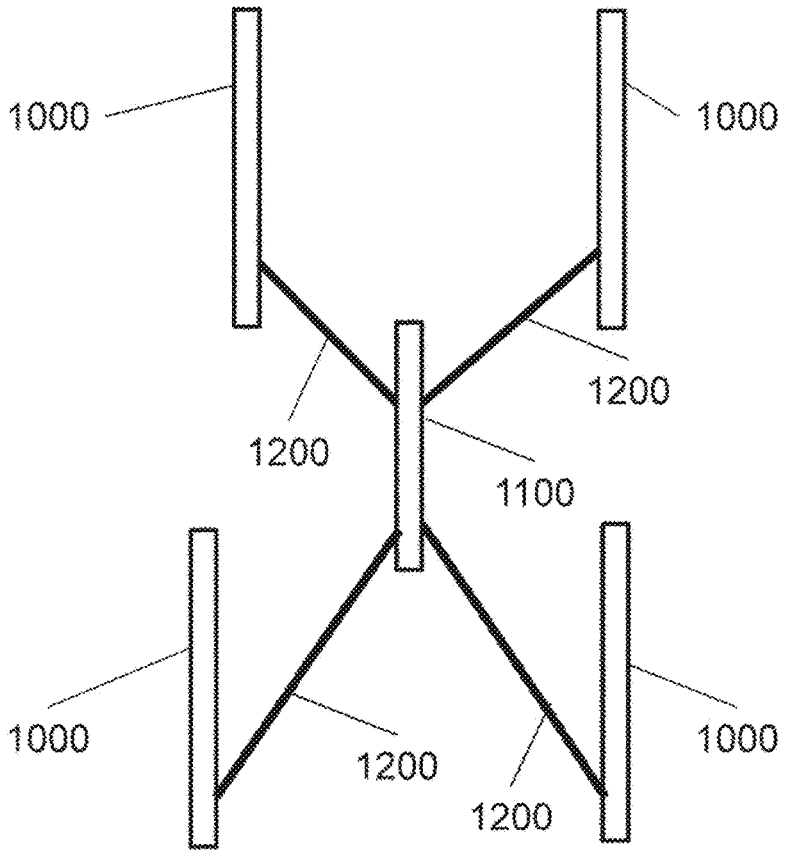
FIGURE 12 (Prior Art)
FIG. 12 is a prior art device for providing an individual positive non-disruptive distraction.

As illustrated in FIG. 11, the multi-orientation modular furniture pieces 100 can be easily orientated to provide multiple configurations in a learning environment. As illustrated, the multi-orientation modular furniture pieces 100 can provide desk/chair combinations, a chair, a stand-alone work surface, a stool, or other configurations, depending upon the orientation of the multi-orientation modular furniture pieces 100.

It is notable that protrusion 122 (not shown) may be engaged with handle 110 (not shown), so as to secure vertical alignment when stacked and further to mitigate potential sidewise displacement.

As set forth above, base surface 116 of furniture piece 100 has a non-flat shape, in order to enable the seat's occupant 130 to engage in a minimal left-right rocking motion while seated. In furtherance of this rocking, furniture piece 100 may be provided with one or more handles for enabling occupant 130 to better control the rocking motion of the seat.

In an exemplary embodiment, furniture piece 100 has a pair of opposed side surfaces 128 on opposites sides of the body of furniture piece 100. Side surfaces 128 extend between the top and bottom of furniture piece 100, e.g., extending from base surface 116 up to seat surface 114, as shown in FIG. 13.

Each side surface 128 includes at least one aperture 132 defined therein. Each aperture 132 forms a handle for the seat's occupant when furniture piece 100 is in the seat orientation. Each aperture includes an upper surface 134, side surfaces 136, and a lower surface 138, the surfaces being spaced apart to accommodate a user's hands while seated in seat surface 120. While only one aperture 132 is shown in each side surface 128, it will be understood that each side surface 128 may include multiple apertures of the type described herein.

The positioning of apertures 132 is not limited. Nonetheless, due to the size of many expected users, apertures 132 are preferably positioned in convenient areas of side surfaces 128 to be used as handles for children and adults. For example, each aperture 132 may be positioned closer to seat surface 114 than base surface 116. Each aperture 132 may be positioned in an area of the respective side surfaces 128 directly between seat surface 114 and base surface 116.

As discussed above and shown generally in the figures, base protrusion 122 defines a recess in the bottom of the body of furniture piece 100 between protrusion 122 and base surface 116. Apertures 132 may be positioned closer to seat surface 114 than any portion of the recess between protrusion 122 and base surface 116. Additionally, apertures 132 may be positioned closer to seat surface 114 than shelf surface 118.

Figure 15:
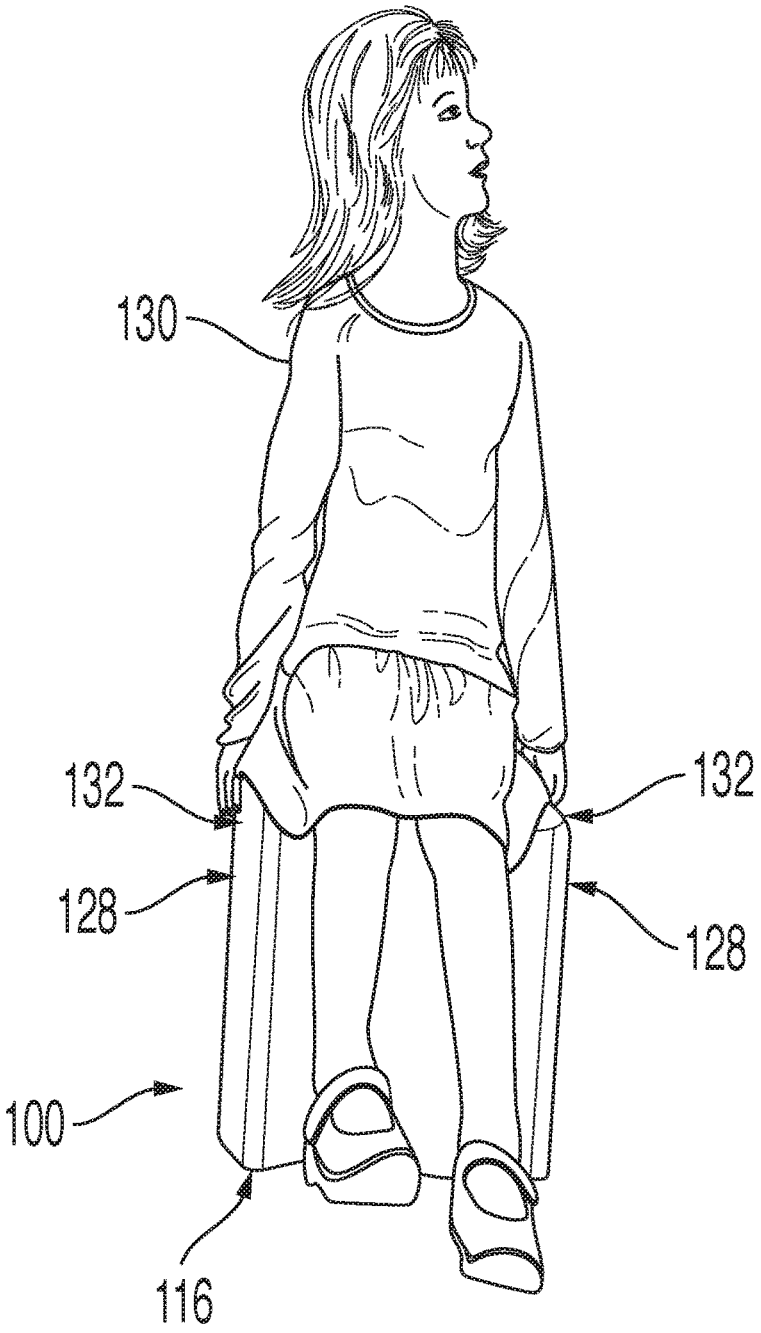
FIG. 15 is a perspective view of the furniture piece of FIG. 13 including an occupant in a rocking motion and grasping the exemplary handles.

In use, base surface 116 is convex in a direction from one side surface 128 to the other side surface 128, to enable the left-right rocking motion described above. During this rocking, the occupant 130 will naturally want to place his or her hands in apertures 132 to maintain his or her balance, as shown in FIG. 15. The upper surface 134 of each aperture 132 faces in a direction opposite seat surface 114, thereby allowing the seat's occupant 130 to pull against the upper surface 134 and rock furniture piece 100 from left to right. Preferably, a plane of each upper surface 134 is substantially parallel to a plane along the periphery of seat surface 114 (i.e. a plane defined by at least two or more peripheral edges of seat surface 114).

Figure 14:
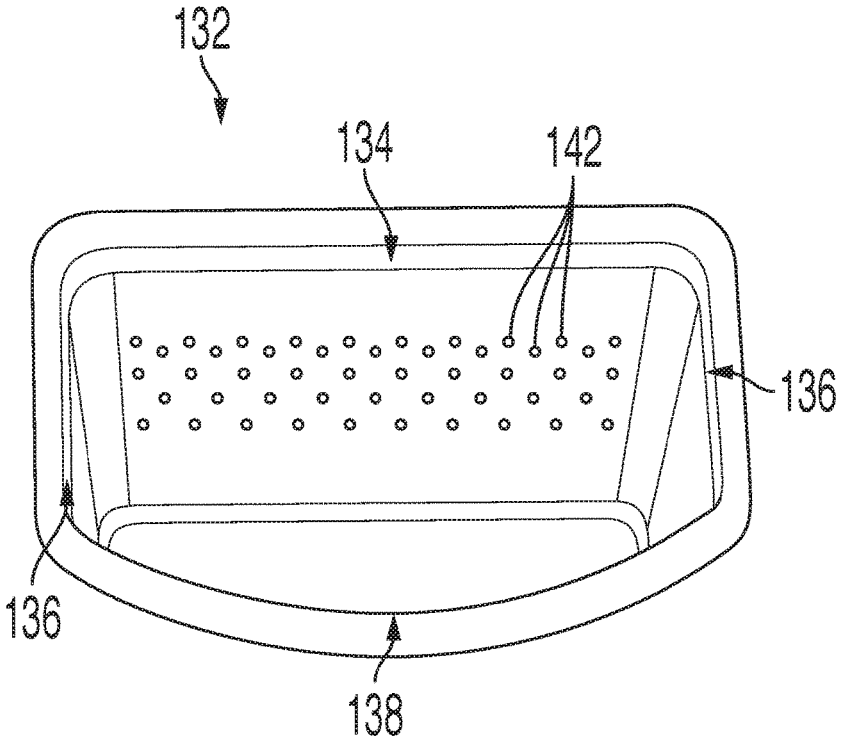
FIG. 14 is a close-up view of the exemplary handles of the furniture piece of FIG. 13.

Upper surface 134 of apertures 132 may be smooth or untextured. However, it may be preferable that upper surface 134 have some roughness, unevenness, or texture, in order to provide tactile sensory stimulation to children or adults grasping apertures 132. In an exemplary embodiment, the upper surface 134 of each aperture 132 has one or more projections formed thereon. More preferably, upper surfaces 134 include multiple projections 142, as shown in FIG. 14. Projections 142 may be positioned in a defined relationship relative to one another, namely, in a predetermined array. Alternatively, projections 142 may be positioned randomly relative to one another. Projections 142 may also have the same or different shapes. In one embodiment, projections 142 all have a common round shape, as shown in FIG. 14.

While the unevenness or roughness is described as being on the upper surface 134 of apertures 132, it will be understood that the invention is not so limited. The unevenness, roughness, or textures described herein may be formed on any of the surfaces of apertures 132. Likewise, the same or different textures may be provided (such as one type of texture on upper surface 134, and another different type of texture on side surfaces 136 and/or lower surface 138).

Placing unevenness or roughness inside top of apertures 132 (i.e., on upper surface 134) allow a discrete location for children in need of greater sensory stimulation while seated. For example, some children may experience hyper- or hypo-activity periods due to sensory processing issues. Such children may find tactile stimulation to be comforting and/or beneficial to their attention span. These children may have the need to touch textures, such as the unevenness or roughness inside apertures 132, as a way to calm themselves. The unevenness or roughness provides this need in a discreet way, so as to not stigmatize the child or disrupt a group of children (such as in a classroom setting).

In summary, a multi-orientation modular furniture piece includes a single form factor that, depending upon the orientation, provides various configurations to facilitate a learning environment. Moreover, multi-orientation modular furniture piece includes non-flat, irregular surfaces to allow the participant to realize a positive non-disruptive distraction to facilitate a non-disruptive release of energy so as to assist in re-focusing the occupant during the learning.

It will be appreciated that several of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed:

1. A furniture piece comprising:

a body;

a base surface on a first side of the body, wherein the base surface is convex;

a seat surface on a second side of the body opposite the first side;

a back protrusion including a pair of side surfaces and a connecting surface disposed therebetween, the back protrusion extending outward from the second side of the body adjacent the seat surface such that a first surface between the pair of side surfaces is adjacent to and extends outwardly from the seat surface;

a pair of opposed side surfaces on opposite sides of the body facing exteriorly away from the seat surface and extending between the first and second sides adjacent to the back protrusion, wherein the base surface convexly extends between the pair of opposed side surfaces and below the seat surface; and a plurality of surfaces including an upper surface, side surfaces, and a lower surface defining an aperture in each of the side surfaces, each respective upper surface of each aperture disposed between the first side and the second side of the body below the seat surface and forwardly spaced away from an area below the back protrusion, such that each aperture is disposed forward of the first surface between the pair of side surfaces of the back protrusion, and each respective upper surface of each aperture is facing in a direction opposite the seat surface toward the base surface.

2. The furniture piece of claim 1, wherein the upper surface of each aperture has one or more projections formed thereon.

3. The furniture piece of claim 2, wherein the upper surface of each aperture has a plurality of projections formed thereon.

4. The furniture piece of claim 3, wherein the plurality of projections are positioned in a defined relationship to one another.

5. The furniture piece of claim 3, wherein the plurality of projections are positioned randomly relative to one another.

6. The furniture piece of claim 3, wherein each of the plurality of projections has a common shape.

7. The furniture piece of claim 3, wherein the plurality of projections have different shapes.

8. The furniture piece of claim 1, wherein the base surface is convex in a direction from one side surface to the other side surface.

9. The furniture piece of claim 1, wherein each aperture is positioned closer to the seat surface than the base surface.

10. The furniture piece of claim 1, wherein each aperture is positioned in an area of the respective side surface between the seat surface and the base surface.

11. The furniture piece of claim 1, wherein a plane of the upper surface of each aperture is substantially parallel to a plane of a periphery of the seat surface.

12. The furniture piece of claim 1, wherein each aperture further includes a pair of opposed side surfaces and a lower surface defined in the respective side surface of the body.

13. The furniture piece of claim 1, further comprising a work surface on a third side of the body extending between the first and second sides.

14. The furniture piece of claim 1, wherein the seat surface is concave.

15. The furniture piece of claim 1, further comprising a recess defined in the first side of the body adjacent the base surface.

16. The furniture piece of claim 15, wherein each aperture is positioned closer to the seat surface than any portion of the recess.

17. The furniture piece of claim 1, further comprising a shelf surface on the second side of the body, the back protrusion positioned between and extending outwardly from both the seat surface and the shelf surface.

18. The furniture piece of claim 17, wherein each aperture is positioned closer to the seat surface than the base surface.

* * * * *